US009041311B2

(12) United States Patent
Myers et al.

(10) Patent No.: US 9,041,311 B2
(45) Date of Patent: May 26, 2015

(54) DYNAMIC LOADING OF POWER SUPPLIES

(75) Inventors: Peter J. Myers, Dunedin, FL (US); Joseph Paul Chobot, Morrisville, NC (US)

(73) Assignee: Cree LED Lighting Solutions, Inc., Durham, NC (US)

( * ) Notice: Subject to any disclaimer, the term of this patent is extended or adjusted under 35 U.S.C. 154(b) by 994 days.

(21) Appl. No.: 12/824,819

(22) Filed: Jun. 28, 2010

(65) Prior Publication Data

US 2011/0234123 A1 Sep. 29, 2011

Related U.S. Application Data

(60) Provisional application No. 61/318,010, filed on Mar. 26, 2010.

(51) Int. Cl.
*H05B 37/02* (2006.01)
*H05B 33/08* (2006.01)

(52) U.S. Cl.
CPC ..... *H05B 33/0815* (2013.01)

(58) Field of Classification Search
CPC ..... H05B 33/0815; H05B 33/0851; H05B 37/02; H05B 33/0818; H05B 33/0845
USPC ..... 315/246, 291, 302, 307
See application file for complete search history.

(56) References Cited

U.S. PATENT DOCUMENTS 4,342,953 A 8/1982 Collins
4,574,276 A 3/1986 Sato
5,773,978 A 6/1998 Becker
7,560,879 B2 7/2009 Chen
7,872,427 B2 * 1/2011 Scianna ..... 315/291
8,018,172 B2 * 9/2011 Leshniak ..... 315/194
2009/0184662 A1 7/2009 Given et al.

(Continued)

FOREIGN PATENT DOCUMENTS

CN 1808875 A 7/2006

OTHER PUBLICATIONS

International Search Report and the Written Opinion of the International Searching Authority Corresponding to International Application No. PCT/US 11/29585; Date of Mailing: May 9, 2011; 7 Pages.

(Continued)

*Primary Examiner* — Jimmy Vu
*Assistant Examiner* — Amy Yang
(74) *Attorney, Agent, or Firm* — Myers Bigel Sibley & Sajovec, P.A.

(57) ABSTRACT

A circuit for altering a level of impedance presented to a power supply including a power supply line includes an energy dissipating circuit, a detection circuit configured to generate a control signal indicative of a power consumption level in a load circuit coupled to the power supply line, and an activation circuit configured to controllably couple the energy dissipating circuit to the power supply line in response to the control signal. Methods of operating a solid state lighting apparatus including a power supply and a solid state lighting device coupled to the power supply include detecting a level of power consumption by the solid state lighting device, and coupling an energy dissipating circuit to the power supply in response to the level of power consumption by the solid state lighting device falling below a threshold level.

21 Claims, 7 Drawing Sheets

(56) References Cited

U.S. PATENT DOCUMENTS

| | | | | |
|---|---|---|---|---|
| 2009/0184666 | A1 | 7/2009 | Myers et al. | |
| 2009/0200953 | A1* | 8/2009 | King | 315/209 R |
| 2011/0235374 | A1* | 9/2011 | Myers et al. | 363/50 |
| 2011/0309759 | A1* | 12/2011 | Shteynberg et al. | 315/201 |

OTHER PUBLICATIONS

International Preliminary Report on Patentability Corresponding to International Application No. PCT/US 11/29585; Date of Mailing: Oct. 11, 2012; 6 Pages.

Chinese Office Action dated Jan. 28, 2014, for corresponding Application No. 201180026029, filed Mar. 23, 2011 (17 pages).

* cited by examiner

DYNAMIC LOADING OF POWER SUPPLIES

CROSS-REFERENCE TO PROVISIONAL APPLICATION

This application claims the benefit of, and priority from, Provisional Application Ser. No. 61/318,010, filed Mar. 26, 2010 entitled DYNAMIC LOADING OF POWER SUPPLIES, the disclosure of which is hereby incorporated herein by reference in its entirety as if set forth fully herein.

FIELD OF THE INVENTION

The present invention relates to solid state lighting apparatus, and in particular relates to control circuits for solid state lighting apparatus.

BACKGROUND

A solid state lighting apparatus is typically designed to be driven with a DC power signal. However, electrical power is commonly delivered using an AC voltage signal, typically 110 to 220 volts at 50 to 60 Hz. Thus, a power converter is typically used to convert an AC power signal to a DC signal that can be used to drive a solid state lighting apparatus.

In general terms, power converter circuits may be used to convey power from a source, such as a battery, electrical power grid, etc. to a load, such as any device, apparatus, or component that runs on electricity, preferably with as little loss as possible. Generally, a power converter circuit provides an output voltage that has a different level than the input voltage.

One type of power converter circuit is known as a switching or switched mode power supply. A switched mode power supply controls the flow of power from a power source to a load by controlling the "on" and "off" duty cycle of one or more transistor switches in order to regulate the DC output voltage across the output terminals of the power supply. The "on" and "off" duty cycle of the one or more transistor switches may be controlled in response to a pulse-width-modulated (PWM) gate drive signal provided by a switching regulator circuit, such that the "on" and "off" duty cycle of the one or more transistor switches is determined by relative pulse-widths of the PWM signal.

Switched mode power supplies have been implemented as an efficient mechanism for providing a regulated output, and are generally more power efficient than linear voltage regulators, which dissipate unwanted power as heat.

Some switched mode power supplies may use a transformer or an inductor as an energy transfer element and a capacitor as an energy storage element. A power transistor may be coupled to one side of the primary winding of a transformer, and may be turned on and off in response to the gate drive signal provided by the switching regulator circuit to alternately store energy in the magnetic field of the transformer and transfer the stored energy to the secondary winding. The secondary winding of the transformer may develop a rectified output voltage across a shunt output capacitor, which is typically an electrolytic capacitor, coupled across the secondary winding as a function of the energy transfer. The voltage across the output capacitor may provide the DC output voltage of the switching power supply.

In many lighting applications, it may be desirable to dim the output of a solid state lighting apparatus. Conventional AC dimming circuits operate using a "phase cut" technique in which portions of the cycles of an AC power signal, such as the leading edge and/or trailing edge are suppressed. The corresponding reduction of energy in the power signal reduces the total luminescent power output by a conventional incandescent light source, causing the light to dim. However, because a solid state lighting apparatus may consume significantly less power than an incandescent device, there may be problems associated with dimming a solid state lighting apparatus in this manner.

For example, for operation of a leading edge, trailing edge, or electronic low voltage (ELV) dimmer on an electronic power supply for the purpose of dimming LEDs, the power consumed by the power supply should be sufficient to ensure proper operation of the dimmer. Insufficient AC line current will commutate (shut off) a triac based dimmer, and may cause erratic operation of an ELV dimmer.

SUMMARY

This Summary is provided to introduce a selection of concepts in a simplified form, the concepts being further described below in the Detailed Description. This Summary is not intended to identify key features or essential features of this application, nor is it intended to limit the scope of the application.

A circuit for altering a level of impedance presented to a power supply including a power supply line according to some embodiments includes an energy dissipating circuit, a detection circuit configured to generate a control signal indicative of a power consumption level in a load circuit coupled to the power supply line, and an activation circuit configured to controllably couple the energy dissipating circuit to the power supply line in response to the control signal.

The energy dissipating circuit may include a startup circuit configured to generate an initial bootstrap current for the power supply.

The power supply may include a power conversion circuit, and the startup circuit may be configured to receive a high voltage DC bus signal and responsively generate a low voltage DC bus signal and to output the low voltage DC bus signal to the power conversion circuit.

The activation circuit may include a transistor having an input terminal configured to receive the control signal and an output terminal coupled to the energy dissipating circuit.

The startup circuit may include a bipolar transistor including a base, a collector and an emitter. The output terminal of the activation circuit may be coupled to the emitter of the bipolar transistor through a diode.

The detection circuit may be configured to generate the control signal in response to a duty cycle of a rectified AC signal generated by the power supply.

The detection circuit may include a first comparator configured to compare a rectified AC signal with a first DC reference value and responsively generate a pulse width modulation (PWM) signal, a filter configured to filter the PWM signal and responsively generate an average signal, and a second comparator configured to compare the average signal with a second DC reference value and responsively generate the control signal.

The first comparator and the second comparator may be configured with open collector outputs.

The detection circuit may be configured to generate the control signal in response to a measure of power consumed by the load circuit.

The circuit may further include a solid state lighting device, a driver circuit coupled to the solid state lighting device and receiving power from the power supply, and a dimming signal generator coupled to the driver circuit and configured to generate a pulse width modulation (PWM)

dimming control signal. The detection circuit may be configured to generate the control signal in response to the dimming control signal output by the dimming signal generator.

Some embodiments provide a circuit for altering a level of impedance presented to a power supply including a power supply line that generates power for a dimmable solid state lighting apparatus. The circuit includes an energy dissipating circuit, a detection circuit configured to generate a control signal indicative of a dimming level of the solid state lighting apparatus, and an activation circuit configured to controllably couple the energy dissipating circuit to the power supply line in response to the control signal.

Methods of operating a solid state lighting apparatus including a power supply and a solid state lighting device coupled to the power supply are provided according to some embodiments. The methods include detecting a level of power consumption by the solid state lighting device, and coupling an energy dissipating circuit to the power supply in response to the level of power consumption by the solid state lighting device falling below a threshold level.

The energy dissipating circuit may include a startup circuit configured to generate an initial bootstrap current for the power supply.

Detecting the level of power consumption may include monitoring a pulse width of a phase cut AC signal output by the power supply.

Detecting the level of power consumption may include monitoring a dimming signal output by a dimming signal generator in the solid state lighting apparatus.

BRIEF DESCRIPTION OF THE DRAWINGS

The accompanying drawings, which are included to provide a further understanding of the invention and are incorporated in and constitute a part of this application, illustrate certain embodiment(s) of the invention. In the drawings.

DETAILED DESCRIPTION OF EMBODIMENTS

Figure 1:
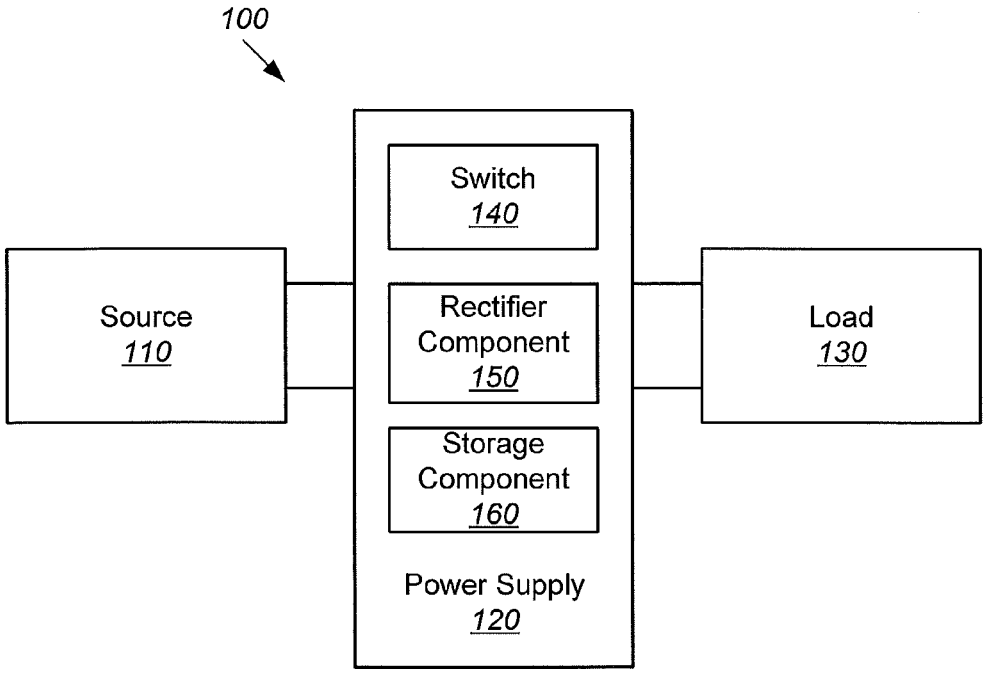
FIG. 1 is a schematic block diagram of a system according to some embodiments including a power source and a power supply coupled to a load.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Some embodiments provide a dynamic load for a power supply that drives a solid state lighting apparatus, such as an LED-based luminaire. In particular, the dynamic load may be activated during times when the luminaire is being dimmed by a dimming circuit ("dimmer") so that AC line current is maintained at levels at which the dimming circuit may operate properly.

During dimming of the luminaire, the consumed power will be low when light levels are low. To ensure proper operation of the dimming controller, some embodiments provide that an additional load may be added as consumed power is reduced.

The additional load may be linear (e.g., resistive) or nonlinear in nature. The magnitude of the loading may be proportional to native consumed power (i.e. the power consumed by the power supply alone), or the magnitude of the loading may be fixed or constant in value.

The additional load may be switched on and off with hysteresis, or may be controlled by means of pulse width modulation (PWM) control signals, or a combination of the two.

In particular embodiments, circuitry for providing the additional load may be provided in, or in connection with, a power supply active start-up circuit. As used herein, a "startup circuit" includes an assemblage of electronic components for the purpose of creating a lower, controlled voltage used to start operation of a switch mode power supply.

A startup circuit for a power supply is typically designed to provide an initial bootstrap current to the power supply. The initial bootstrap current is typically derived from the AC line or from a rectified DC bus, and is typically active for only a brief period during initial startup of the power supply. In addition to its primary function, in some embodiments the startup circuit may be used to provide a load on the AC line and/or rectified DC bus. Thus, in some embodiments, the startup circuit may be used as a dissipation means for dissipating energy to thereby change a load presented to the power supply.

According to some embodiments, a detection and activation circuit can be provided to detect an appropriate time for activating the dynamic load. The detection and activation circuit can be configured to perform one or more of the following functions:

Detection of AC line phase. In order to activate the dynamic load at an appropriate phase cut, detection means, such as a detection and activation circuit, may be configured in some embodiments to detect the AC line phase. This may be achieved, for example, by monitoring the voltage at certain nodes in the circuit. In particular, this may be achieved by measuring the AC line directly, for example, using RMS, averaging, or pulse width techniques, monitoring the rectified DC bus, for example, using RMS, averaging, or pulse width techniques, and/or monitoring the line frequency envelope on the secondary side of the active switching power supply circuit. This may be performed using a low pass filter having a bandwidth that is sufficient to pass the AC line frequencies with low attenuation, typically 120 Hz or lower, but that attenuates the active circuit switching frequency, which is typically 50 kHz or higher Monitoring the power supply load. In some embodiments, the power supply load may be monitored so as to activate the dynamic load at the appropriate load point. The power supply load may be monitored, for example, by monitoring average load voltage and current using well known current and voltage measurement techniques. In some embodiments, the power supply load may be monitored indirectly by monitoring a PWM dimming signal average value or duty cycle percentage as discussed in more detail below, as this represents the LED loading.

Monitoring the processed dimming signal. The processed dimming signal may, in some embodiments, be monitored so as to activate the dynamic load at the appropriate power level or time.

Activating the dynamic load. When the detection and activation circuit determines that the dynamic load should be activated, activation means, such as an activation circuit, may generate a control signal that controls the dynamic load.

In some embodiments, activation of a startup circuit as a dynamic load may be performed in such a manner as to not disrupt the normal operation of the controlling elements of the supply.

Referring now to FIG. 1, a system 100 according to some embodiments includes a power source 110, a power supply 120, such as, for example, a switch mode or current regulating power supply, and a load 130, which are connected as shown. The power source 110 may be an Alternating Current (AC) power supply. As shown in FIG. 1, the power supply 120 includes a switch 140, a rectifier component 150, and a storage component 160, such as a capacitor. The load 130 may be any apparatus or device that receives the output voltage/current generated by the power supply 120 responsive to an input voltage/current received from the power source 110.

Figure 2:
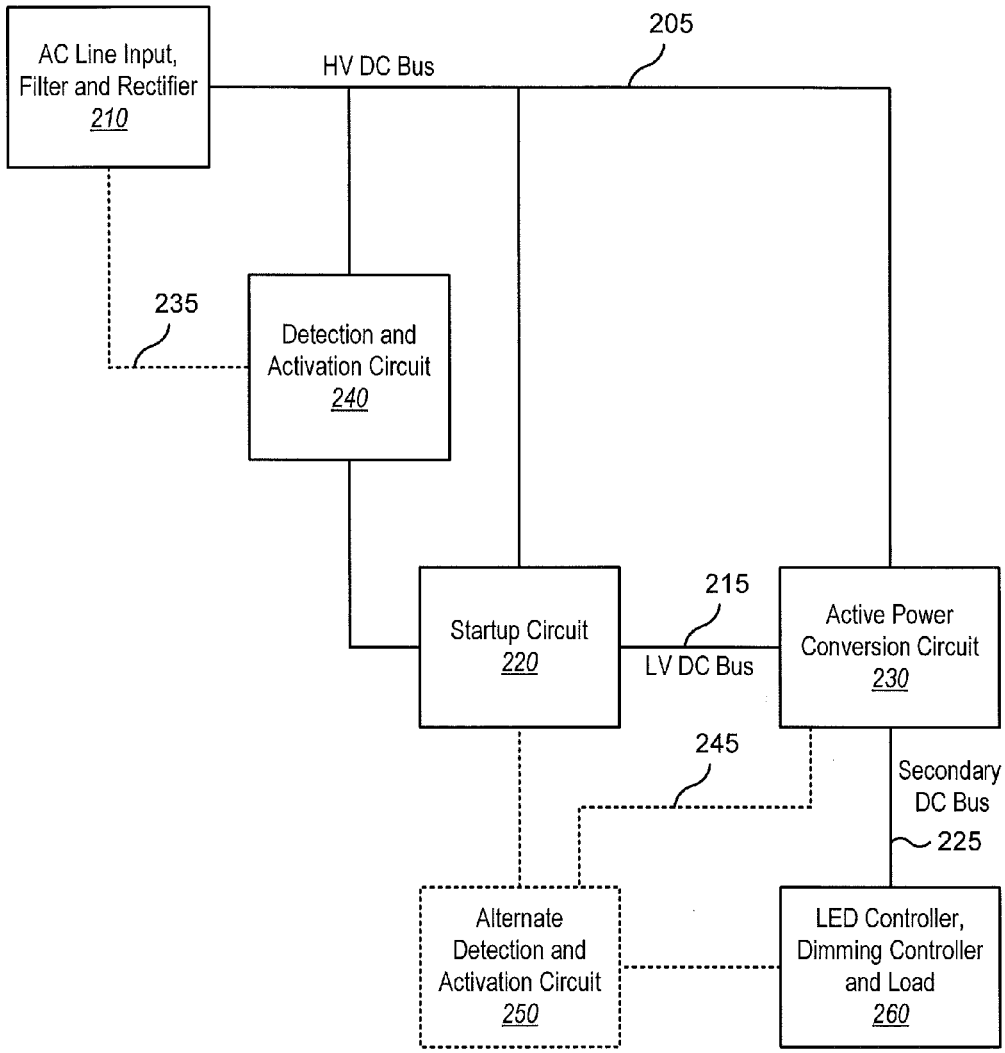
FIG. 2 is a schematic block diagram illustrating a dynamic loading circuit according to some embodiments that is coupled to a power supply.

Various aspects of the power supply 120 of FIG. 1 are illustrated in more detail in FIG. 2. Referring to FIG. 2, the system 100 includes an AC line input, filter and rectifier 210, a startup circuit 220, and an active power conversion circuit 230 that are configured to supply power to an LED controller, a dimming controller and the load 260, which may include, for example, one or more strings of solid state lighting devices. Also provided is a detection and activation circuit 240. An alternate detection and activation circuit 250 is also illustrated in FIG. 2.

An AC line input is filtered and rectified to generate a high voltage (HV) rectified DC bus signal 205. The HV DC bus signal 205 is provided to the startup circuit 220 and to the active power conversion circuit 230. The startup circuit 220 generates a low voltage (LV) primary DC bus signal 215 that is provided to the active power conversion circuit 230. The active power conversion circuit 230 generates a secondary DC bus signal 225 that is provided as a power supply signal to the LED controller, dimmer and load 260.

Detection and activation circuitry 240 is provided to control operation of the startup circuit to act as a load during periods of low power consumption (e.g., during dimming). The detection and activation circuitry 240 may be driven by the HV rectified primary bus signal 205 and/or directly from the AC line input via line 235.

Alternate detection and activation circuitry 250 may in some embodiments be coupled to the LED controller, dimming controller and/or load instead of the detection and activation circuit 240 to cause the startup circuit 220 to provide a supplemental load under low power conditions in accordance with some embodiments. The alternate detection and activation circuitry 250 may in some embodiments be configured to monitor the active power conversion circuit 230 via line 245.

The detection and activation circuitry 240, 250 may monitor the AC line signal, the power supply load and/or the dimming signal as discussed above and generate a control signal CONTROL (FIG. 3) that is used to controllably cause the startup circuit to act as an additional, or supplemental, load, to thereby potentially avoid problems associated with low power consumption while using a dimming circuit with a solid state lighting apparatus as described above.

Figure 3:
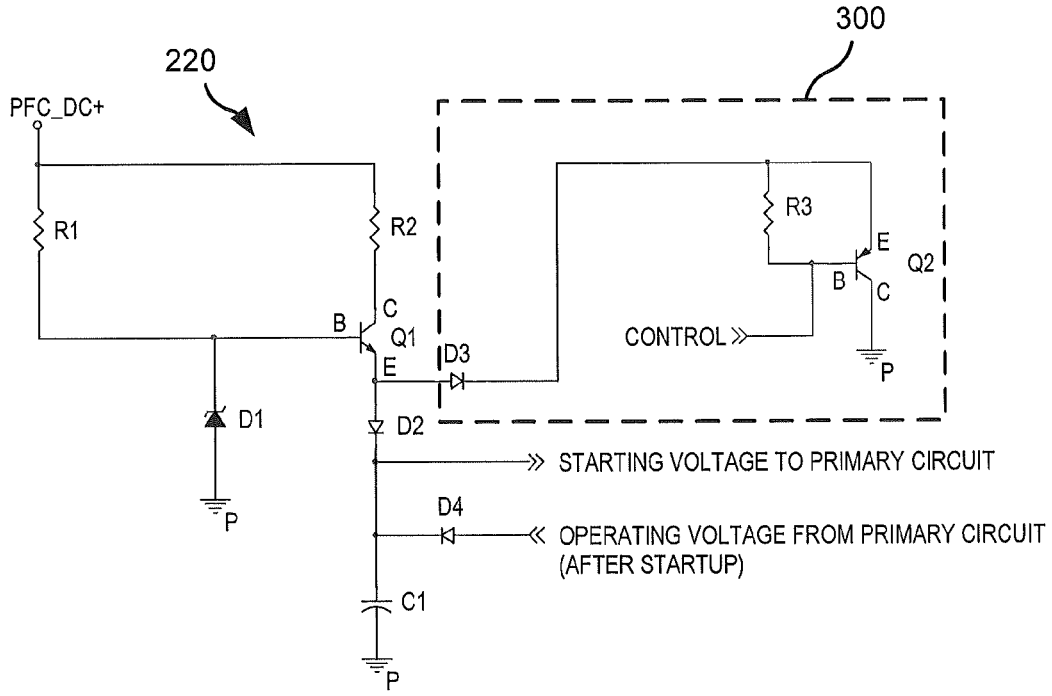
FIG. 3 is a schematic circuit diagram that illustrates a startup circuit according to some embodiments.

A startup circuit 220 and an activation circuit 300 according to some embodiments are illustrated in FIG. 3. The startup circuit 220 illustrated in FIG. 3 includes resistors R1 and R2, transistor Q1, diodes D1, D2, and D4, and capacitor C1. The activation circuit 300 includes diode D3, resistor R3 and transistor Q2.

In FIG. 3 and in the following discussion, "PFC_DC+" refers to a high voltage DC signal generated by rectification of an AC line voltage. "Primary circuit" refers to a switch-mode controller and associated components used convert PFC_DC+ to a different, regulated value. "CONTROL" refers to a signal created for the purpose of activating the startup circuit as a dynamic load.

Operation of circuits/methods according to some embodiments will now be described with reference to FIG. 3.

1) At time 0, assume all voltages are zero.

2) At time 0+ (just after time 0), PFC_DC+ will rise to some value based on the voltage of the AC line. The control signal CONTROL will be off and the control terminal will be at high impedance.

Current will begin to flow through resistor R1 into the base (B) of Q1 (an NPN transistor), turning transistor Q1 ON. Current will then flow through resistor R2, limited by the resistance of resistor R2 or by the gain of transistor Q1, and will exit from the emitter (E) of transistor Q1.

Current flowing from the emitter of transistor Q1 will then divide between diodes D2 and D3. Diode D4 will block current from flowing into areas of the primary circuit that are not required for startup.

Current through the diode D3 will be small, just enough to bias the transistor Q2, which, as a PNP transistor, will be OFF.

The majority of current flowing from the emitter of transistor Q1 will flow through diode D2 into capacitor C1, charging capacitor C1.

Diode D1, a zener diode, will not conduct current at this point (i.e., while the voltage on the capacitor C1 is low).

As capacitor C1 charges, the voltage on the capacitor C1 will rise. The cathode voltage of diode D2 will equal the voltage on the capacitor C1, and the anode voltage on the diode D1 will be one forward voltage drop higher than the voltage on the capacitor C1 (D2*vf*).

The voltage at the emitter of transistor Q1 will equal the anode voltage of diode D2 anode, or C1+D2*vf*.

The base voltage of the transistor Q1 will equal the voltage on the emitter of transistor Q1 plus one diode drop, or C1+2*D2*vf*.

When the voltage on capacitor C1 increases such that the base voltage on the transistor Q1 equals the zener voltage of D1 (D1*vz*), the base voltage of transistor Q1 voltage will be clamped at D1*vz*.

An NPN bipolar junction transistor (BJT) requires that the emitter voltage be lower than the base to conduct, assuming the voltage at the collector (C) is also higher than the voltage at the emitter. With the base voltage of the transistor Q1 clamped at voltage D1*vz*, the emitter voltage of the transistor Q1 will not rise above the base voltage of Q1 due to the conduction of the transistor Q1, and is effectively shut off, or clamped, at a level that is just below (e.g. one diode drop below) the base voltage of the transistor Q1.

Any consumption of current by the primary circuit will lower the voltage on C1, which will lower the emitter voltage of the transistor Q1, bringing the transistor Q1 back into the active region. In this manner, a reasonably constant voltage will be maintained at the emitter of the transistor Q1.

When the primary circuit activates, it will necessarily operate at a higher voltage than that of the starting voltage. The operating voltage will feed back current through the diode D4, increasing the voltage on the capacitor C1. A higher voltage on the capacitor C1 will prevent the emitter voltage on the transistor Q1 from decreasing and bringing Q1 into the active region, effectively keeping Q1 in the OFF state.

After startup is complete, to activate the starting circuit when the primary circuit is operating, the voltage on the emitter of the transistor Q1 may be reduced to bring the transistor Q1 into the active region of operation.

In the circuit illustrated in FIG. 3, the transistor Q2 is connected to Q1 such that the pair is in a 'cascode' configuration. The transistor Q2, being biased through the resistor R3, remains in the off state.

When the control signal CONTROL that is applied to the base of the transistor Q2 goes low relative to the emitter of the transistor Q2, the transistor Q2 will be in the active region, and will thus conduct current between the collector and emitter. The control signal CONTROL is generated in response to a monitoring circuit (e.g., the detection and activation circuits 240, 250 in FIG. 2) indicating that the power consumption by the power supply is low, which could potentially cause undesirable operation of the dimmer circuit.

Conduction of the transistor Q2 will lower the voltage on the emitter of the transistor Q1 through the diode D3, bringing it into the active region. The diode D2 will block current from the primary circuit from flowing into the emitters of the transistors Q1 and Q2. Thus, the emitter of the transistor Q2 remains the controlling element for the activation of the transistor Q1.

With the transistor Q1 active, current flows through the resistor R2, through Q1 and Q2, to circuit common. This provides the supplemental dynamic loading to the primary supply circuit.

Release of the control signal CONTROL (e.g., placing it in a high impedance state) will allow the self-biasing transistor Q2 go into cutoff, consequently allowing the voltage at the emitter of the transistor Q1 to rise and bring Q1 into the cutoff region.

In various embodiments, the transistor Q2 may be a BJT, MOSFET, or thyristor. Furthermore, Q2 could in some embodiments be a mechanical or solid state relay. The control signal CONTROL may be generated from any number of analog or digital circuits, including microcontrollers and ASICs.

For example, the CONTROL signal may be generated based on the output of a dimming detection circuit such as that described in United States Publication No. 2009/0184666, entitled "Frequency Converted Dimming Signal Generation" and United States Publication No. 2009/0184662, entitled "Dimming Signal Generation and Methods of Generating Dimming Signals," both of which are assigned to the assignee of the present application and are incorporated by reference herein in their entireties as if physically present. These applications describe various techniques for dimming light emitting devices using dimmers that are compatible with traditional incandescent and fluorescent lighting control circuitry, including AC phase cut dimmers, level control signal dimmers and pulse width modulation (PWM) dimmers.

In particular, the output of an averaging circuit as described in these applications may be compared to a threshold value to generate the CONTROL signal if the output falls below the threshold value (i.e. the phase cut of the AC line reaches or exceeds a certain level).

Figure 4:
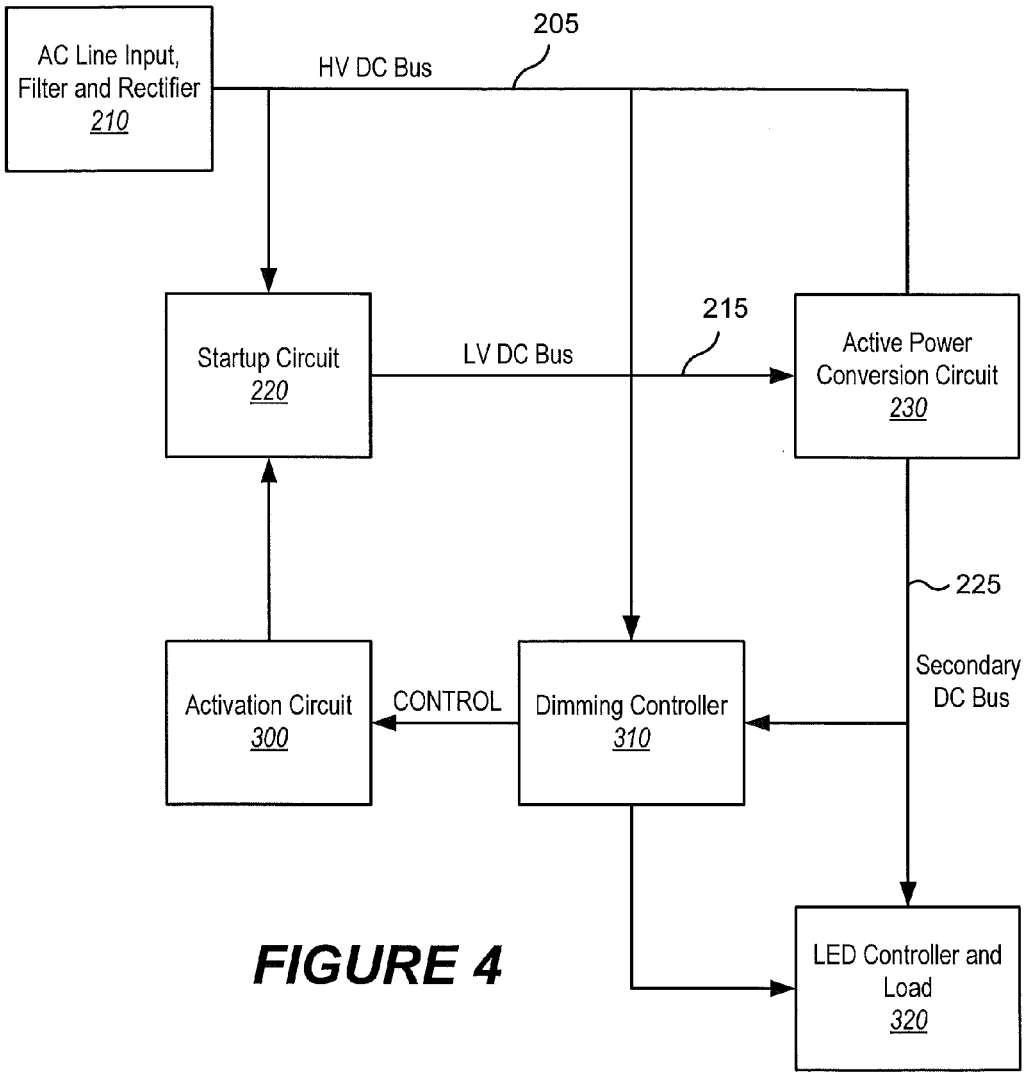
FIG. 4 is a schematic block diagram illustrating a dynamic loading circuit according to further embodiments that is coupled to a power supply.

FIG. 4 illustrates an apparatus according to some particular embodiments in which the control signal is taken from the output of a dimming control circuit 310.

Referring to FIG. 4, an activation circuit 300 is coupled to the startup circuit 220 and to a dimming controller 310. The dimming controller 310 is coupled to the HV DC bus line 205, the secondary DC bus line 225, the detection and activation circuit 300 and an LED controller and load 320.

The dimming controller 310, which is powered by the secondary DC bus signal generated by the active power conversion circuit 230, monitors the voltage on the un-filtered rectified DC bus 205.

Figure 5A:
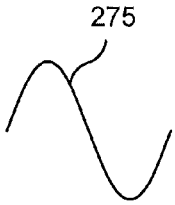
FIGS. 5A and 5B illustrate effects of phase cut dimming operations on a power supply voltage signal.

The dimming controller 310 monitors the degree of phase cut of the rectified AC input. As will be appreciated, a conventional phase-cut dimmer circuit operates by "cutting out" part of the AC waveform. For example, referring to FIGS. 5A and 5B, a phase-cut dimmer circuit converts a sinusoidal input voltage into a phase-cut voltage. FIG. 5A shows one period of a sinusoidal input voltage 275, although it will be appreciated that the input voltage may not be perfectly sinusoidal.

Figure 5B:
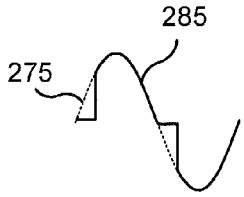

FIG. 5B shows one period of a voltage signal 285 that has been phase-cut. The sinusoidal input voltage 275 is shown as a dashed line for reference. In each cycle, the voltage does not turn on until after a phase delay that may be regulated, for example, by a triac-based AC dimming circuit.

When the appropriate degree of phase cut is reached, a two-level output signal (the CONTROL signal) changes state. The control signal is fed to the activation circuit 300, and the activation of the startup circuit 220 as a supplemental load.

Referring again to FIG. 3, the transistor Q2 in the activation circuit 300 is turned on by the application of the CONTROL signal on the base terminal (B) thereof. With the transistor Q2 in an ON state, the emitter (E) of the transistor Q1 is brought to a voltage level that is below the voltage of the base (B) of the transistor Q1 by a sufficient amount to cause the transistor Q1 to operate in the active region.

Consequently, current flows through the resistor R2, through transistor Q1, and through transistor Q2, thereby loading the PFC_DC+ bus.

Because the primary circuit operating voltage is supplied by the active primary circuit, and the diode D2 blocks current feed through to the transistor Q2, operation of the primary circuit may be unaffected.

Figure 6:
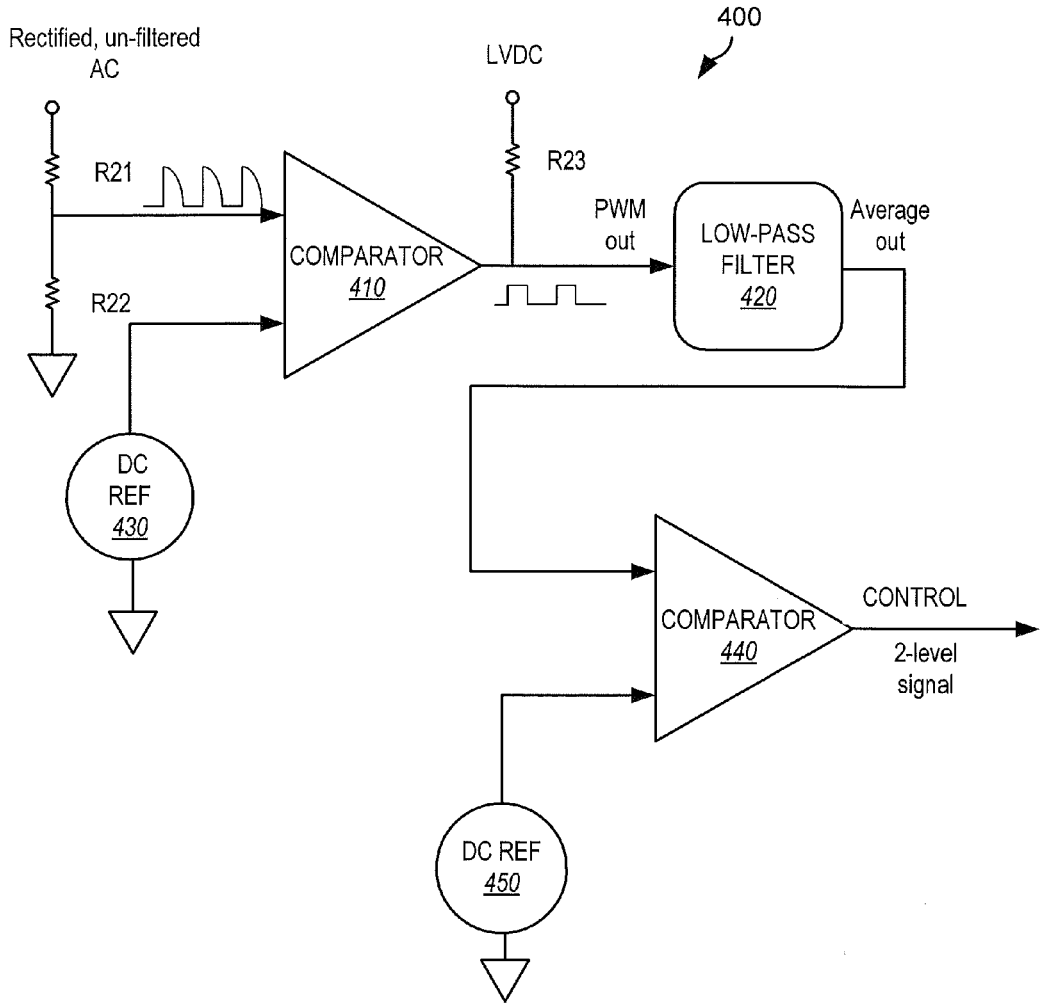
FIG. 6 is a schematic circuit diagram that illustrates a circuit for generating a control signal according to some embodiments.

FIG. 6 illustrates a detection circuit 400 according to some embodiments. The detection circuit 400 may be implemented, for example, within the dimming controller 310 illustrated in FIG. 4 or separately from the dimming controller 310.

In the detection circuit 400, the un-filtered, rectified AC voltage is scaled by voltage divider resistors R21 and R22 to a non-destructive level suitable as an input to a first comparator 410, which is designed with an open collector output (i.e., if the comparator output is off, or inactive, the output impedance to circuit ground is high, and if the output is on, or active, the output impedance to circuit ground is low).

The time-varying rectified AC signal is compared to a fixed DC reference 430. When the signal is greater than the reference, the output of the first comparator 410 is inactive, or high; otherwise the output is active, or low. The AC signal is lower than the reference in the valleys of the rectified AC signal. The signal is also lower during the "off" portion of a phase cut dimmer controlling the AC line.

The output of the first comparator 410 is coupled to the LVDC signal through a resistor R23. The output of the first comparator 410 will therefore have two voltage values: 0 (LOW) or a fixed value (HIGH). There will be no intermediate values except during the fast transition from LOW to HIGH and vice-versa.

The output of the first comparator 410 is therefore a PWM representation of the rectified AC line duty cycle.

The output of the first comparator 410 is processed by an RC low-pass filter 420, which generates an average DC value representation of the signal at the output of the first comparator 410.

The output of the filter 420 is provided as an input to a second comparator 440, which is also designed with an open collector output. A second fixed DC reference 450 is also provided as an input to the second comparator 440. The output of the second comparator 440 provides the control signal CONTROL. Thus, if the average value output by the filter 420 is greater than the second reference voltage 450, then the output is inactive and the CONTROL signal is held at high impedance. If the input is less than the reference, the output is at low impedance, and the CONTROL signal is grounded. The second reference voltage 450 may therefore be chosen to cause the output of the second comparator 440 to have low impedance to ground (thereby turning the transistor Q2 ON and activating the startup circuit 220 as a supplemental load) when the dimming of the apparatus is increased beyond a predetermined threshold level.

Figure 7:
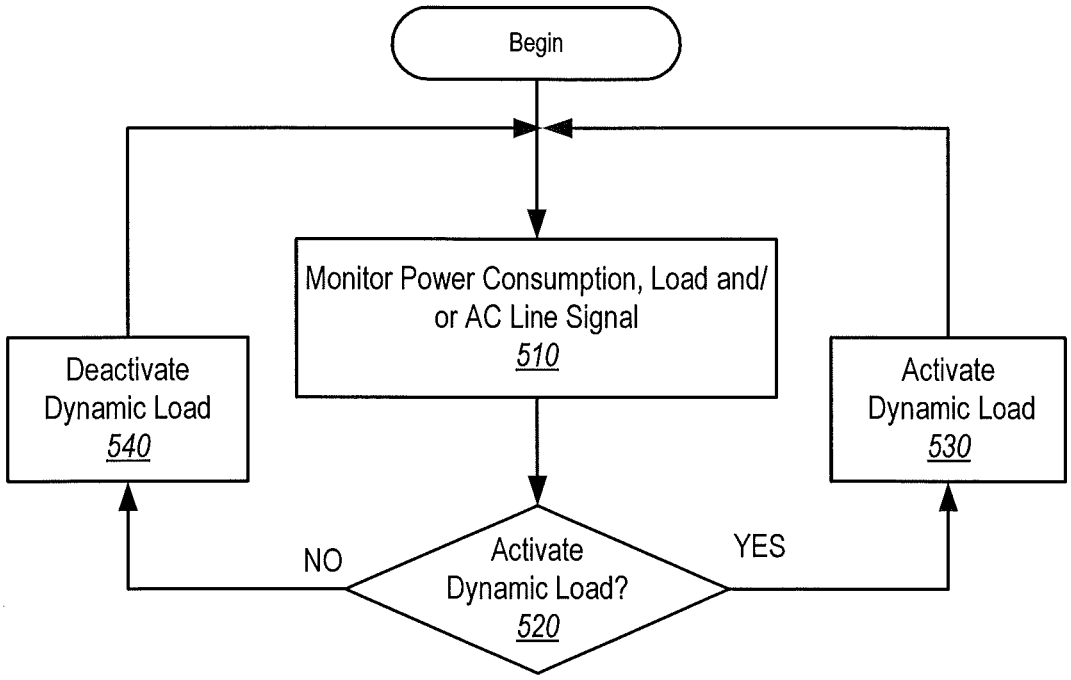
FIG. 7 is a flowchart illustrating operations of systems/methods according to some embodiments.

FIG. 7 illustrates operations of circuits/systems according to various embodiments of the invention. In Block 510, various aspects of a solid state lighting apparatus are monitored, such as power consumption of a power supply, the level of the load, and/or the AC line voltage. Based on the results of the monitoring, a determination is made whether or not to activate a dynamic load to thereby increase the power consumption of the apparatus (Block 520). If it is determined that the power consumption should be increased, the dynamic load is activated (Block 530). Otherwise, the dynamic load is deactivated (Block 540).

Figure 8:
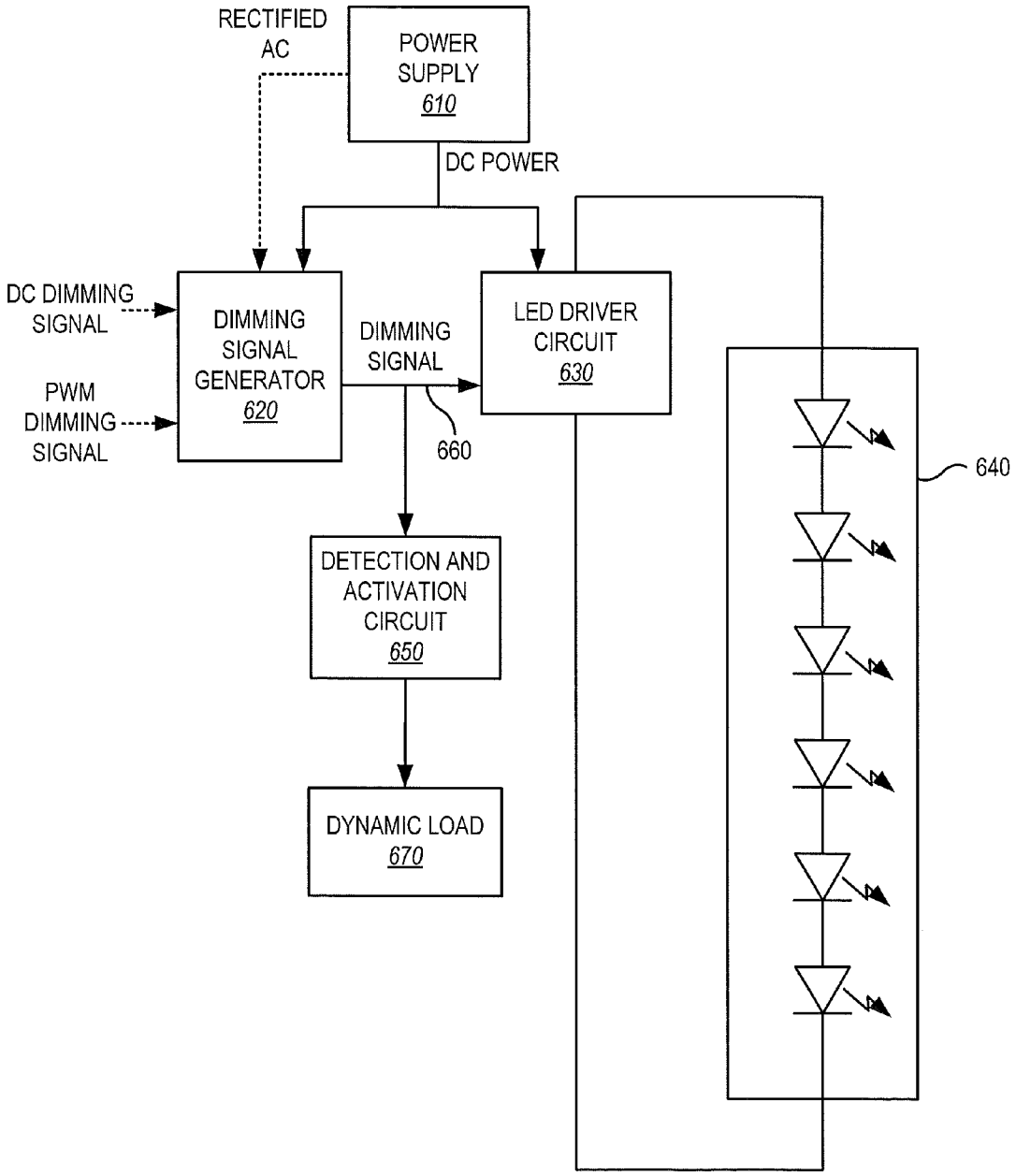
FIG. 8 is a schematic circuit diagram that illustrates a circuit for generating a control signal according to further embodiments.

FIG. 8 is a schematic circuit diagram that illustrates a circuit for generating a control signal for controlling dynamic loading of a power supply according to further embodiments. In the circuit illustrated FIG. 8, a detection and activation circuit 650 detects dimming of a solid state lighting apparatus in response to a dimming signal generated by a dimming signal generator 620.

In the embodiments of FIG. 8, a lighting device is powered from an AC line input. The lighting device includes one or more LEDs 640, an LED driver circuit 630, a power supply 610 and a dimming signal generator circuit 620. The power supply 610 receives an AC line input and provides DC power to the LED driver circuit 630 and the dimming signal generator circuit 620. The power supply 610 may be any suitable power supply including, for example, buck or boost power supplies as described in U.S. patent application Ser. No. 11/854,744. Also, the LED driver circuit 630 may be any suitable LED driver circuit capable of supplying a fixed amplitude current to the LEDs 640 in response to a control signal of variable duty cycle. The particular configurations of the LED driver circuit 630 and/or the power supply 610 will depend on the application of the lighting device.

The dimming signal generator circuit 620 is configured to receive at least one of (1) a PWM dimming signal, (2) a DC dimming signal and (3) a rectified AC input that reflects a phase cut AC dimming signal and responsively generates a dimming control signal 660 that controls the duty cycle of the current signal generated by the LED driver circuit 630. In particular, the dimming control signal 660 is a pulse width modulated signal having a duty cycle that is indicative of a desired level of dimming, and may be generated based on a duty cycle of pulse width modulated dimming signal, a voltage level of a DC dimming signal, and/or an amount of phase cut in a rectified AC signal.

The detection and activation circuit 650 monitors the dimming control signal 660 and responsively couples/decouples a dynamic load 670, such as the load presented by the startup circuit 220 (FIG. 2), to the power supply 610.

Embodiments of the present invention may provide for an added load in the presence of a dimming signal. Such load may be needed if the number of lighting devices on the dimming circuit is small. The added load may reduce the number of lighting devices needed on the circuit to allow the dimming circuit to be stable when dimming the lighting devices. In some embodiments, the load is sufficient that the dimming circuit will exhibit stable operation when only a single lighting device is present. If multiple lighting devices are present on the circuit, then all of the lighting devices need not switch in the dynamic load. Thus, in some embodiments, the use of the dynamic load may be set by a user when the lighting devices are installed. For example, a switch disconnect the CONTROL signal such that the dynamic load would not be switched in even if dimming is detected. The user could switch all but the minimum number of lighting devices needed to provide stable dimming operation and, thereby, reduce total power consumption.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

In the drawings and specification, there have been disclosed typical embodiments of the invention and, although specific terms are employed, they are used in a generic and descriptive sense only and not for purposes of limitation, the scope of the invention being set forth in the following claims.

That which is claimed:

1. A circuit for altering a level of impedance presented to a power supply including a power supply line, comprising:

an energy dissipating circuit;

a detection circuit configured to detect a power consumption level in a load circuit coupled to the power supply line and to generate a control signal indicative of the detected power consumption level falling below a threshold power consumption level; and an activation circuit configured to controllably couple the energy dissipating circuit to the power supply line in response to the control signal to cause the energy dissipating circuit to draw current from the power supply line in response to the control signal.

2. The circuit of claim 1, wherein the energy dissipating circuit comprises a startup circuit configured to generate an initial bootstrap current for the power supply.

3. The circuit of claim 2, wherein the power supply comprises a power conversion circuit, and wherein the startup circuit is configured to receive a high voltage DC bus signal and responsively generate a low voltage DC bus signal and to output the low voltage DC bus signal to the power conversion circuit.

4. The circuit of claim 2, wherein the activation circuit comprises a transistor having an input terminal configured to receive the control signal and an output terminal coupled to the energy dissipating circuit.

5. The circuit of claim 4, wherein the startup circuit comprises a bipolar transistor including a base, a collector and an emitter, wherein the output terminal of the activation circuit is coupled to the emitter of the bipolar transistor through a diode.

6. The circuit of claim 1, wherein the detection circuit is configured to generate the control signal in response to a duty cycle of a rectified AC signal generated by the power supply.

7. The circuit of claim 6, wherein the detection circuit comprises a first comparator configured to compare a rectified AC signal with a first DC reference value and responsively generate a pulse width modulation (PWM) signal, a filter configured to filter the PWM signal and responsively generate an average signal, and a second comparator configured to compare the average signal with a second DC reference value and responsively generate the control signal.

8. The circuit of claim 7, wherein the first comparator and the second comparator are configured with open collector outputs.

9. The circuit of claim 1, wherein the detection circuit is configured to generate the control signal in response to a measure of power consumed by the load circuit.

10. The circuit of claim 1, further comprising:

a solid state lighting device;

a driver circuit coupled to the solid state lighting device and receiving power from the power supply; and a dimming signal generator coupled to the driver circuit and configured to generate a pulse width modulation (PWM) dimming control signal;

wherein the detection circuit is configured to generate the control signal in response to the dimming control signal output by the dimming signal generator.

11. A circuit for altering a level of impedance presented to a power supply including a power supply line that provides power for a dimmable solid state lighting apparatus, the circuit comprising:

an energy dissipating circuit;

a detection circuit configured to provide a control signal in response to a dimming level of the solid state lighting apparatus; and an activation circuit configured to controllably couple the energy dissipating circuit to the power supply line in response to the control signal to cause the energy dissipating circuit to draw current from the power supply line in response to the control signal.

12. The circuit of claim 11, wherein the energy dissipating circuit comprises a startup circuit configured to generate an initial bootstrap current for the power supply.

13. The circuit of claim 12, wherein the power supply comprises a power conversion circuit, and wherein the startup circuit is configured to receive a high voltage DC bus signal and responsively generate a low voltage DC bus signal and to output the low voltage DC bus signal to the power conversion circuit.

14. The circuit of claim 11, wherein the activation circuit comprises a transistor having an input terminal configured to receive the control signal and an output terminal coupled to the energy dissipating circuit.

15. The circuit of claim 14, wherein the startup circuit comprises a bipolar transistor including a base, a collector and an emitter, wherein the output terminal of the activation circuit is coupled to the emitter of the bipolar transistor through a diode.

16. The circuit of claim 11, further comprising:

a solid state lighting device;

a driver circuit coupled to the solid state lighting device and receiving power from the power supply;

a dimming signal generator coupled to the driver circuit and configured to generate a pulse width modulation (PWM) dimming control signal;

wherein the detection circuit is configured to generate the control signal in response to the dimming control signal output by the dimming signal generator.

17. A method of operating a solid state lighting apparatus including a power supply and a solid state lighting device coupled to the power supply, the method comprising:

detecting a level of power consumption by the solid state lighting device; and coupling an energy dissipating circuit to the power supply to cause the energy dissipating circuit to draw current from the power supply in response to the level of power consumption by the solid state lighting device falling below a threshold level.

18. The method of claim 17, further comprising:

generating a control signal in response to the detecting, wherein the coupling an energy dissipating circuit in response to the level of power consumption by the solid state lighting device further comprises:

receiving the control signal at a base of a first transistor, wherein the control signal is a low signal in response to detecting the level of power consumption falling below the threshold level;

turning on the first transistor in response to the control signal at the base; and turning on a second transistor, in the energy dissipating circuit, coupled to an emitter of the first transistor in response to the turning on of the first transistor, wherein current flows through the energy dissipating circuit to provide a supplemental load to the power supply.

19. The method of claim 17, wherein detecting the level of power consumption comprises monitoring a pulse width of a phase cut AC signal output by the power supply.

20. The method of claim 17, wherein detecting the level of power consumption comprises monitoring a dimming signal output by a dimming signal generator in the solid state lighting apparatus.

21. A circuit for altering a level of impedance presented to a power supply including a power supply line, comprising:

dissipation means for dissipating energy;

detection means for detecting a power consumption level in a load circuit coupled to the power supply line and generating a control signal indicative of the detected power consumption level falling below a threshold power consumption level; and activation means configured to controllably couple the dissipation means to the power supply line in response to the control signal to cause the dissipation means to draw current from the power supply line in response to the control signal.

* * * * *